US011898280B2

(12) United States Patent
Jang

(10) Patent No.: US 11,898,280 B2
(45) **Date of Patent: *Feb. 13, 2024**

(54) CLOTHING-MANUFACTURING KNITTING MACHINE

(71) Applicant: Kookmin University Industry Academy Cooperation Foundation, Seoul (KR)

(72) Inventor: Jung Sik Jang, Gyeonggi-do (KR)

(73) Assignee: Kookmin University Industry Academy Cooperation Foundation, Seoul (KR)

( * ) Notice: Subject to any disclaimer, the term of this patent is extended or adjusted under 35 U.S.C. 154(b) by 169 days.

This patent is subject to a terminal disclaimer.

(21) Appl. No.: 17/426,650

(22) PCT Filed: Nov. 6, 2020

(86) PCT No.: PCT/KR2020/015452
§ 371 (c)(1),
(2) Date: Jul. 29, 2021

(87) PCT Pub. No.: WO2022/097781
PCT Pub. Date: May 12, 2022

(65) Prior Publication Data

US 2022/0372679 A1 Nov. 24, 2022

(30) Foreign Application Priority Data

Nov. 5, 2020 (KR) ..... 10-2020-0146555
Nov. 5, 2020 (KR) ..... 10-2020-0146557

(51) Int. Cl.
*D04B 15/82* (2006.01)
*D04B 15/94* (2006.01)

(52) U.S. Cl.
CPC ..... *D04B 15/82* (2013.01); *D04B 15/94* (2013.01)

(58) Field of Classification Search
USPC ..... 66/72, 78
See application file for complete search history.

(56) References Cited

U.S. PATENT DOCUMENTS 2,239,378 A * 4/1941 Brillhart ..... D04B 35/04 66/8
2,348,932 A 5/1944 Scrantom
(Continued)

FOREIGN PATENT DOCUMENTS

EP 0235987 9/1987
JP 2003221767 A * 8/2003 ..... D04B 15/96
(Continued)

OTHER PUBLICATIONS

Supplementary European Search Report and the European Search Opinion dated Sep. 5, 2022 From the European Patent Office Re. Application No. 20914768.5. (8 Pages).
(Continued)

*Primary Examiner* — Aiying Zhao

(57) ABSTRACT

A clothing-manufacturing knitting machine, and the clothing-manufacturing knitting machine that includes a needle unit including a needle hook formed in an end portion and a protrusion formed in a middle region, a connector including a screw thread formed to mesh with the protrusion of the needle unit, and an actuator configured to actuate the connector to rotate. The needle unit meshing with the screw thread is moved forward or backward as the connector is rotated by the actuator. Accordingly, there is provided a clothing-manufacturing knitting machine with a new actuating system.

11 Claims, 5 Drawing Sheets

(56) References Cited

U.S. PATENT DOCUMENTS

| | | | | | |
|---|---|---|---|---|---|
| 3,013,418 | A * | 12/1961 | Hill | D04B 15/322 | 66/57 |
| 3,614,877 | A * | 10/1971 | Suppe | D04B 15/327 | 66/57 |
| 4,768,357 | A * | 9/1988 | Ohtake | D04B 1/104 | 66/126 R |
| 4,856,298 | A * | 8/1989 | Maruyama | D04B 15/82 | 66/219 |
| 6,810,695 | B1 * | 11/2004 | Wang | D04B 15/82 | 66/57 |

FOREIGN PATENT DOCUMENTS

| | | | | |
|---|---|---|---|---|
| JP | 2019-073818 | | 5/2019 | |
| JP | 2019073818 | A * | 5/2019 | D04B 15/70 |
| KR | 10-1674546 | | 11/2016 | |
| KR | 10-1866451 | | 6/2018 | |
| KR | 10-2019-0041407 | | 4/2019 | |

OTHER PUBLICATIONS

International Search Report and the Written Opinion dated Jul. 30, 2021 From the International Searching Authority Re. Application No. PCT/KR2020/015452 and Its Translation of Search Report Into English. (8 Pages).

Hudson "Printing Teddy Bears: A Technique for 3D Printing of Soft Interactive Objects", Proceedings of the SIGCHI Conference on Human Factors in Computing Systems, CHI '14, Toronto, ON, Canada, Apr. 26-May 1, 2014, p. 459-468, Apr. 26, 2014.

* cited by examiner

CLOTHING-MANUFACTURING KNITTING MACHINE

RELATED APPLICATIONS

This application is a National Phase of PCT Patent Application No. PCT/KR2020/015452 having International filing date of Nov. 6, 2020, which claims the benefit of priority of Korean Patent Application Nos. 10-2020-0146557 filed on Nov. 5, 2020 and 10-2020-0146555 filed on Nov. 5, 2020. The contents of the above applications are all incorporated by reference as if fully set forth herein in their entirety.

FIELD AND BACKGROUND OF THE INVENTION

The disclosure relates to a clothing-manufacturing knitting machine, and more particularly to a clothing-manufacturing knitting machine of which a needle unit for clothing manufacturing is moved forward and backward by a simple structure.

In general, a flat-knitting machine or the like knitting machine is employed to manufacture clothing. The flat-knitting machine knits cloth with a programmed pattern while a carriage feeds a plurality of needles arranged in a needle unit with threads by reciprocating left and right above the needle unit. AI principle of actuating a conventional flat-knitting machine is as follows. The needle of the needle unit is formed with a protrusion, and the carriage is formed with a track corresponding to the butt on the rear thereof, so that the protrusion can move along the track while the carriage reciprocates. With this structure, the needles move forward or backward as a whole, thereby performing knitting. Such general things about the flat-knitting machine have been disclosed in Korean Patent Application No. 10-2020-0007693, etc.

However, a conventional knitting machine has had a problem that the carriage needs to reciprocate between both ends of the arranged needle unit.

Further, a forward and backward moving distance of the needle unit is varied depending on the track formed in the carriage, and therefore there has been a problem of difficulty in freely adjusting the forward and backward moving distance of the needle unit.

An aspect of the disclosure is to solve such conventional problems, and provide a clothing-manufacturing knitting machine with a new actuating system.

Another aspect of the disclosure is to provide a clothing-manufacturing knitting machine in which forward and backward movement of a needle unit is freely adjustable.

SUMMARY OF THE INVENTION

According to an embodiment of the disclosure, there is provided a knitting machine for clothing, comprising: a needle unit comprising a needle hook formed in an end portion and a protrusion formed in a middle region; a connector comprising a screw thread formed to mesh with the protrusion of the needle unit; and an actuator configured to actuate the connector to rotate, wherein the needle unit meshing with the screw thread is moved forward or backward as the connector is rotated by the actuator.

Here, the connector is movable closer to or far away from the needle unit in a direction intersecting with a lengthwise direction of the needle unit, thereby selectively transmitting or releasing an actuation force.

The needle units are provided in plural, the connector are provided in plural, the connectors are fewer than the needle units, and the connector selectively meshes with the protrusion of the needle unit while moving in parallel with a direction where the plurality of needle units are arranged.

The actuator is rotatable forward and backward to generate a forward and backward actuation force for the needle unit, and the actuator further comprises an encoder to adjust the number of rotations of the connector.

According to the disclosure, there is provided a clothing-manufacturing knitting machine with a new actuating system.

Further, there is provided a clothing-manufacturing knitting machine in which forward and backward movement of a needle unit is freely adjustable.

DESCRIPTION OF SPECIFIC EMBODIMENTS OF THE INVENTION

Below, a clothing-manufacturing knitting machine according to a first embodiment of the disclosure will be described in detail with reference to the accompanying drawings.

Figure 1:
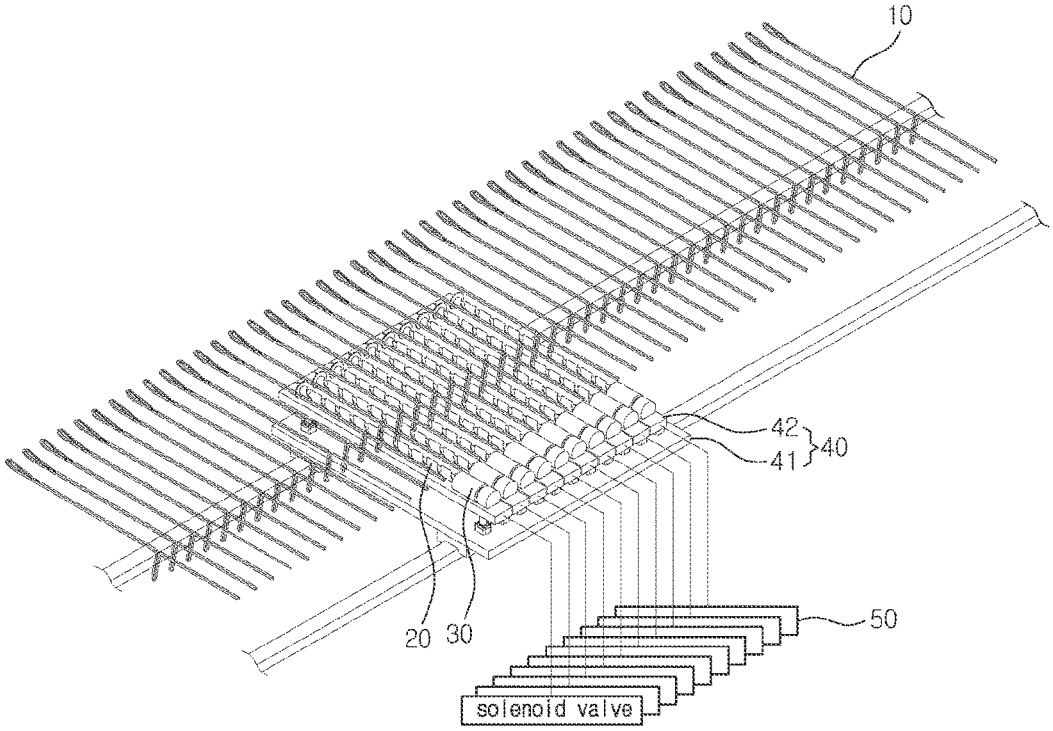
FIG. 1 is a perspective view illustrating a main configuration of a clothing-manufacturing knitting machine according to a first embodiment of the disclosure.
Figure 2:
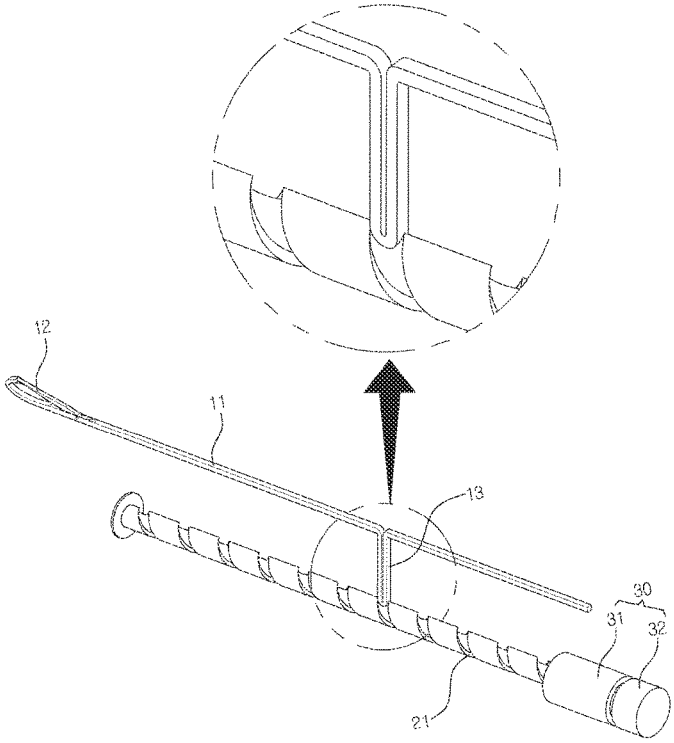
FIG. 2 is a perspective view illustrating an actuation mechanism of the clothing-manufacturing knitting machine according to the first embodiment of the disclosure.

FIG. 1 is a perspective view illustrating a main configuration of a clothing-manufacturing knitting machine according to a first embodiment of the disclosure, and FIG. 2 is a perspective view illustrating an actuation mechanism of a needle unit and a connector. As shown therein, the clothing-manufacturing knitting machine according to the disclosure includes a needle unit 10, a connector 20, an actuator 30, a supporting plate 40 and a solenoid valve 50.

The needle unit 10 includes a main body 11 formed long in a lengthwise direction, a needle hook 12 formed at one end of the main body 11 and hooking a thread, a protrusion 13 formed in a certain region of the main body 11. The needle hook 12 has a structure by which a thread positioned in front thereof is hooked as the needle unit 10 is moved forward, and the hooked thread is pulled backward as the needle unit 10 is moved backward. The protrusion 13 protrudes outward from the certain region of the main body 11 and meshes with the connector 20. The protrusion 13 in the drawings is formed by bending the main body 11 twice, but the protrusion may have any structure without being bent twice as long as it protrudes from the main body 11.

Figure 3:
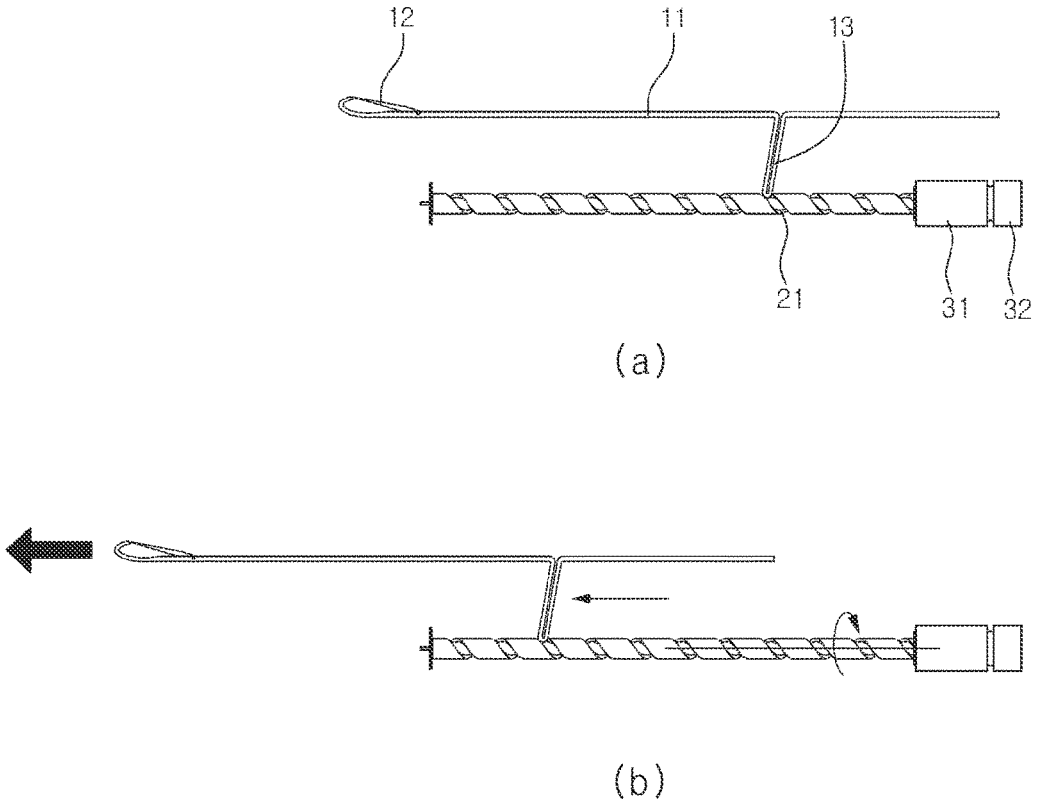
FIG. 3 illustrates a principle of actuating a needle unit in the clothing-manufacturing knitting machine according to the first embodiment of the disclosure.

The connector 20 transmits a rotational force generated by the actuator 30 to the needle unit 10 so that the needle unit 10 can move forward and backward, and has a body formed with a screw thread 21 with which the protrusion 13 of the needle unit 10 meshes. A width of a groove of the screw thread 21 may be the same as or a little wider than the width of the protrusion 13 of the needle unit 10, so that the protrusion 13 of the needle unit 10 can be inserted in the groove. Therefore, as shown in FIG. 3, when the connector 20 rotates, the protrusion 13 of the needle unit 10 inserted in the groove of the screw thread 21 moves forward or backward along the screw thread 21 while interlocking with the rotation of the connector 20. The forward or backward moving distance of the needle unit 10 is varied depending on the number of rotations of the connector 20.

The actuator 30 is embodied by a motor 51 that can rotate the connector 20. In this embodiment, the motor is described by way of example. However, any actuator may be used as long as it can rotate the connector 20. Further, the actuator 30 may include an encoder 32 to sense the number of rotations of the connector 20 and control the forward and backward moving distance of the needle unit 10.

The connectors 20 may be provided fewer than the needle units 10, and be selectively in contact with the needle units 10 while the connector 20 moves left and right on the plurality of needle units 10 arranged side by side in a row, thereby transmitting an actuation force to the needle unit 10.

Figure 4:
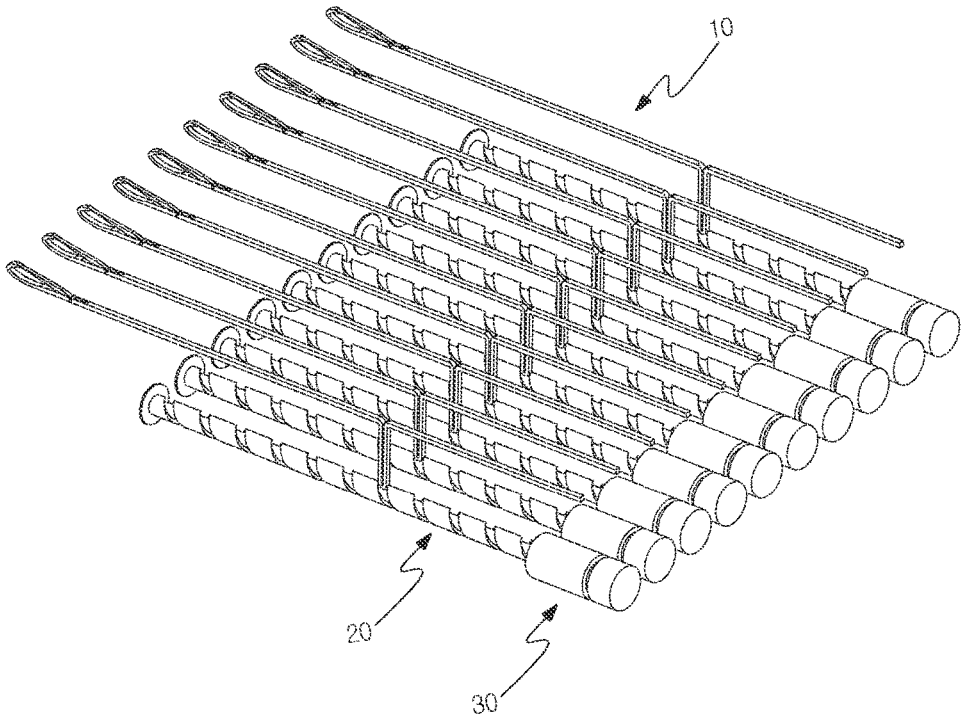
FIG. 4 is a perspective view showing a needle unit, a connector and an actuator of the clothing-manufacturing knitting machine according to the first embodiment of the disclosure.
Figure 5:
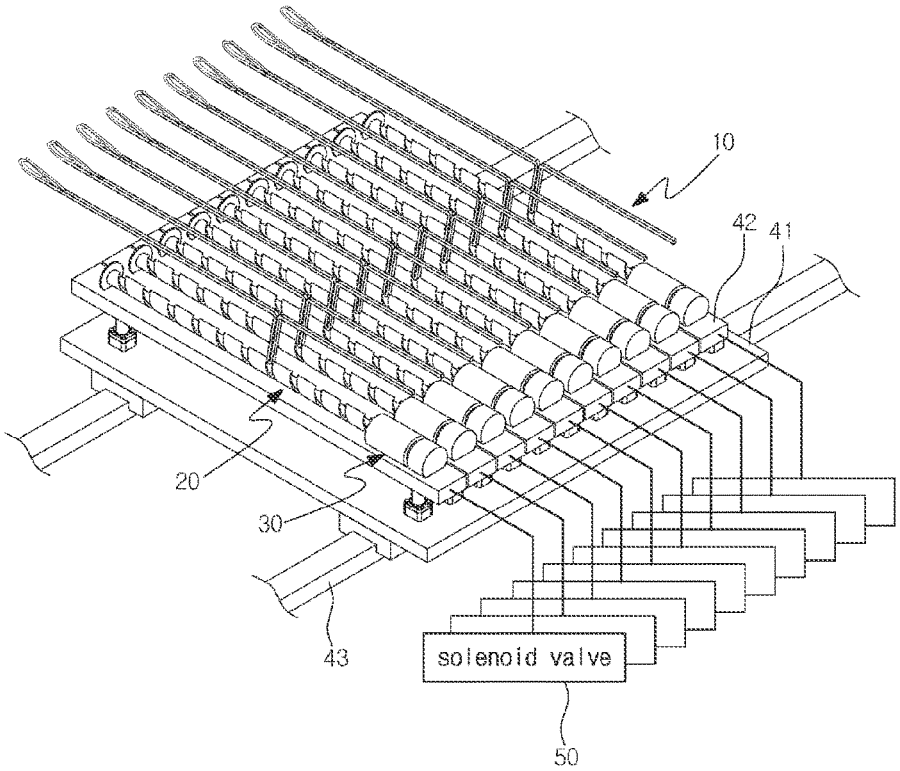
FIG. 5 is a perspective view showing a supporting plate of the clothing-manufacturing knitting machine according to the first embodiment of the disclosure.

FIG. 4 is a perspective view showing a needle unit, a connector and an actuator of the clothing-manufacturing knitting machine according to the first embodiment of the disclosure, and FIG. 5 is a perspective view showing a supporting plate of the clothing-manufacturing knitting machine according to the first embodiment of the disclosure. As shown therein, the supporting plate 40 is provided to support the connector 20 and the actuator 30. The supporting plate 40 includes a first plate 41 and a second plate 42, and the first plate 41 is mounted to a rail 43 and movable in left and right directions intersecting with a lengthwise direction of the needle unit 10. The second plate 42 is mounted to the first plate 21 and movable up and down, and provided as many as the number of connectors 20 and the number of actuators 30 to support the connector 20 and the actuator 30.

Figure 6:
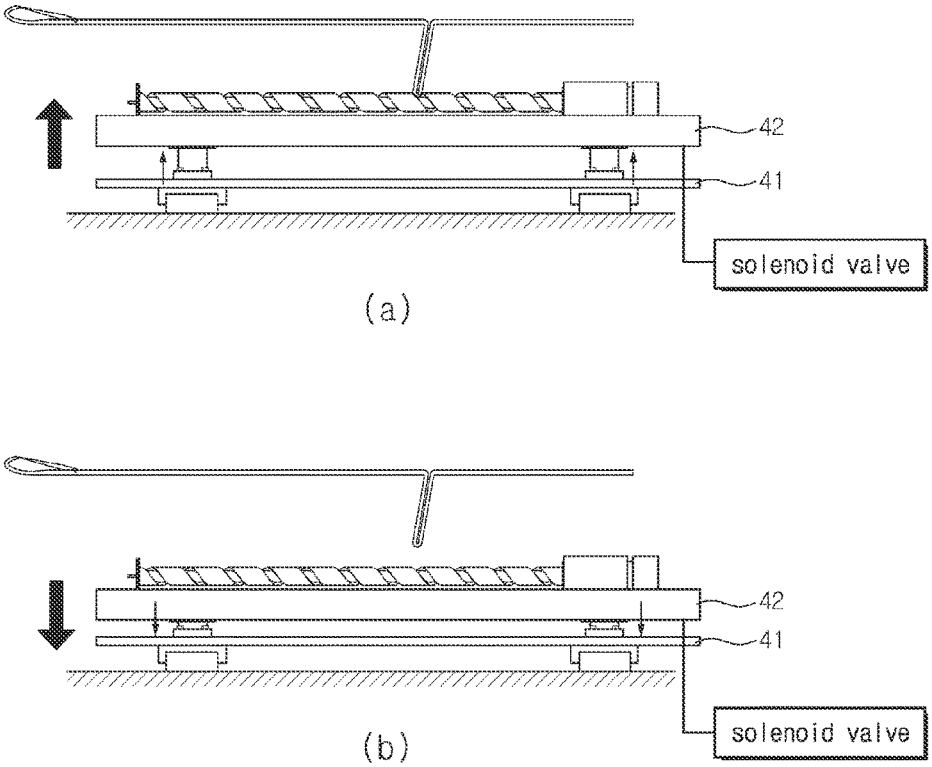
FIG. 6 illustrates actuation of a solenoid valve of the clothing-manufacturing knitting machine according to the first embodiment of the disclosure.

FIG. 6 illustrates actuation of a solenoid valve of the clothing-manufacturing knitting machine according to the first embodiment of the disclosure. As shown therein, the solenoid valves 50 are respectively connected to the second plates 42, so that the second plates 42 can move up and down. Therefore, the solenoid valve 50 actuates the second plate 42 to independently move up and down, so that the connector 20 and the needle unit 10 can mesh with or be released from each other for linking or unlinking.

From now on, the actuation of the clothing-manufacturing knitting machine according to the first embodiment will be described.

First, the supporting plate 40 supporting the connector 20 and the actuator 30 is moved left and right along a rail 43, and placed at a position corresponding to the needle unit 10 to be actuated. Then, the solenoid valve 50 actuates the second plate 42 of the supporting plate 40 to move upward. As the second plate 42 moves upward, the connector 20 supported on the second plate 42 also moves upward, and therefore the protrusion 13 of the needle unit 10 is inserted in the groove of the screw thread 21 of the connector 20.

Next, the actuator 30 actuates the connector 20 to rotate, and the rotation of the connector 20 causes the protrusion 13 meshing with the screw thread 21 to move forward, thereby moving the needle unit 10 forward. At this time, the number of rotations of the connector 20 is sensed by the encoder 32, and the forward moving distance of the needle unit 10 is adjusted based on the number of rotations of the connector 20.

When the needle unit 10 moves forward up to a given position, the thread is hooked to the needle hook 12 of the needle unit 10. Then the actuator 30 is reversely rotated to move the needle unit 10 backward, and therefore the thread hooked to the needle hook 12 is also moved backward. With such an actuation mechanism, the needle unit 10 moves forward and backward to perform knitting, and the supporting plate 40 reciprocates to manufacture clothing having a desired size or a desired shape.

Figure 7:
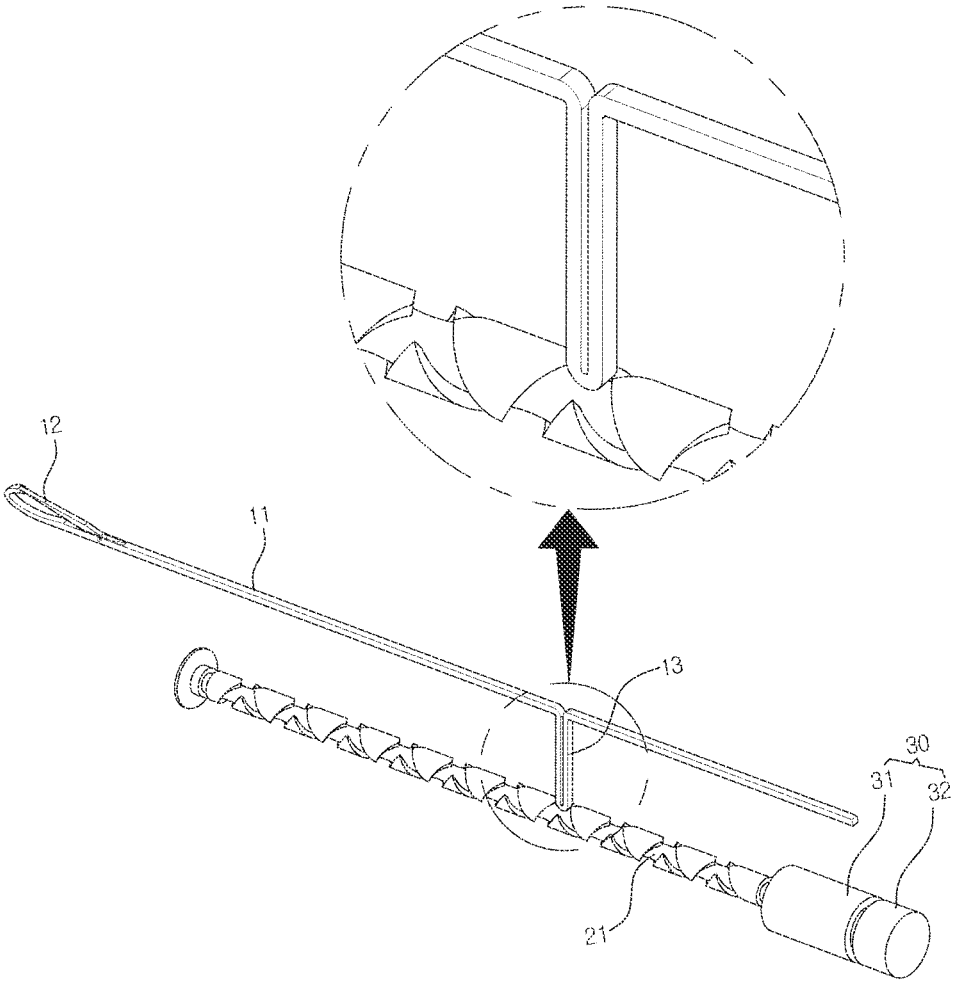
FIG. 7 is a perspective view illustrating an actuation mechanism of a clothing-manufacturing knitting machine according to a second embodiment of the disclosure.
Figure 8:
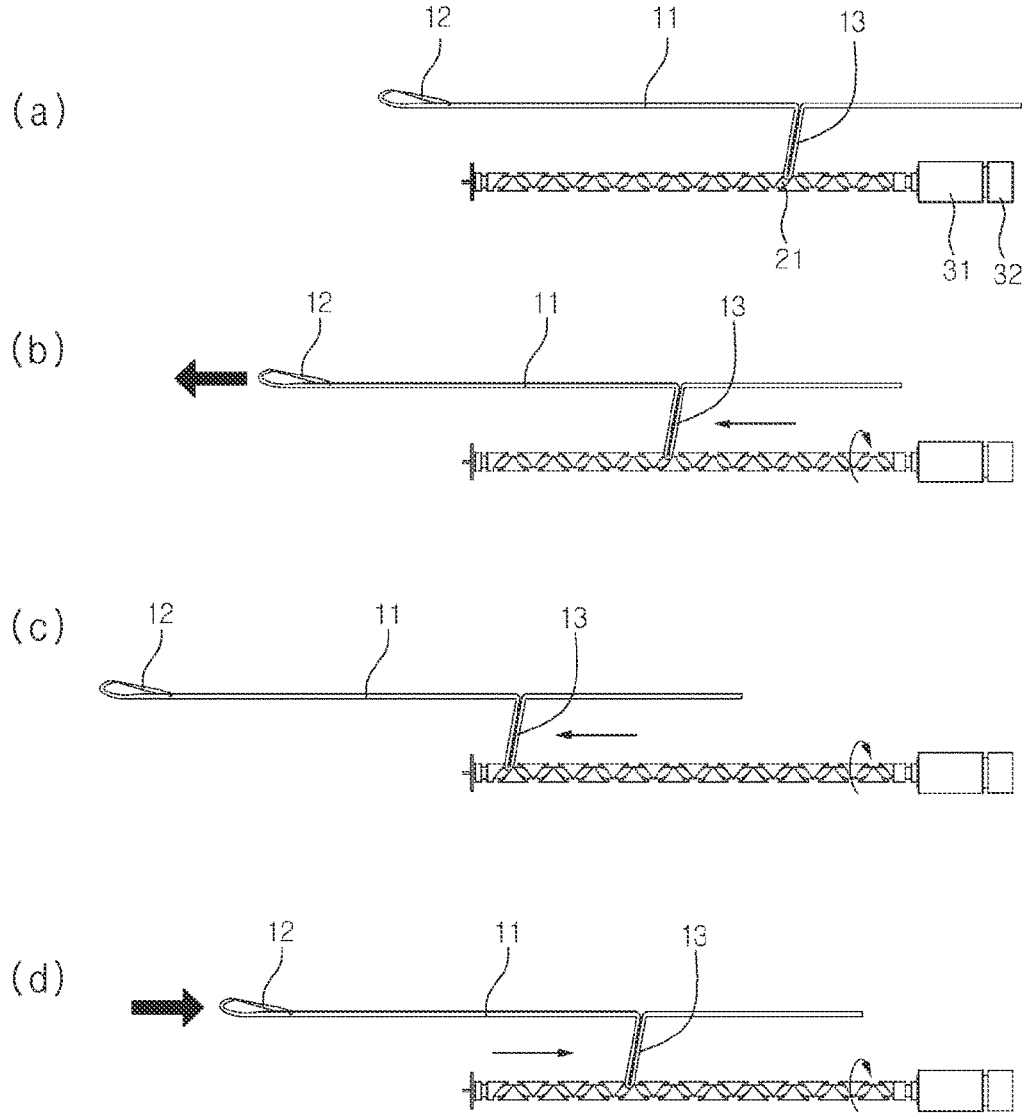
FIG. 8 illustrates actuation of the clothing-manufacturing knitting machine according to the second embodiment of the disclosure.

Below, a clothing-manufacturing knitting machine according to a second embodiment of the disclosure will be described. In the following description, descriptions about elements like those of the first embodiment will be omitted. FIG. 7 is a perspective view illustrating an actuation mechanism of a clothing-manufacturing knitting machine according to a second embodiment of the disclosure, and FIG. 8 illustrates actuation of the clothing-manufacturing knitting machine according to the second embodiment of the disclosure. As shown therein, in the clothing-manufacturing knitting machine according to the second embodiment of the disclosure, the screw thread 21 formed in the connector 20 is provided as a self-reversing screw. The self-reversing screw refers to a screw of which screw threads are not formed only in one direction but formed to intersect so that an object moving along the screw can move in a reverse direction to a previous moving direction when the object reaches a certain position.

When the thread is hooked to the needle hook 12 of the needle unit 10 as the needle unit 10 moves forward up to the given position, the protrusion of the needle unit 10 is placed at a position where direction switching of the self-reversing screw is possible, and the needle unit 10 is moved backward even though the actuator 30 rotates in the same direction. At this time, the thread hooked to the needle hook 12 is also moved backward. With such an actuation mechanism, the needle unit 10 moves forward and backward to perform knitting, and the supporting plate 40 reciprocates to manufacture clothing having a desired size or a desired shape.

The scope of the disclosure is not limited to the foregoing embodiments, but may be embodied in various forms within the scope of the appended claims. The scope of the claims appended in the disclosure falls within various scopes in which any changes can be made by a person having ordinary knowledge in the art to which the disclosure pertains, without departing from the gist of the disclosure defined in the claims.

There is provided a knitting machine for clothing, which includes a needle unit formed with a needle hook in an end portion and a protrusion in a middle region, a connector formed with a screw thread to mesh with the protrusion of the needle unit, and an actuator actuating the connector to rotate, wherein the needle unit meshing with the screw thread is moved forward or backward as the connector is rotated by the actuator.

The invention claimed is:

1. A knitting machine for clothing, comprising:

a needle unit comprising:

a main body, and a needle hook formed in an end portion of the main body and a protrusion formed in a middle region of the main body;

a connector comprising a screw thread formed to mesh with the protrusion of the main body of the needle unit; and an actuator configured to actuate the connector to rotate, wherein the needle unit meshing with the screw thread is moved in a longitudinal direction of the main body as the connector is rotated by the actuator.

2. The knitting machine for clothing according to claim 1, wherein the connector is movable closer to or far away from the needle unit in a direction intersecting with the longitudinal direction of the main body of the needle unit.

3. The knitting machine for clothing according to claim 1, wherein the needle unit is one of a plurality of needle units of the knitting machine, the plurality of needle units are arranged side by side.

4. The knitting machine for clothing according to claim 3, wherein the connector is one of a plurality of connectors of the knitting machine, the plurality of connectors are arranged side by side.

5. The knitting machine for clothing according to claim 4, wherein the plurality of connectors are fewer than the plurality of needle units, and the connector selectively meshes with the protrusion of the needle unit while moving in parallel to the plurality of needle units.

6. The knitting machine for clothing according to claim 1, wherein the actuator is rotatable clockwise and counter-clockwise.

7. The knitting machine for clothing according to claim 1, wherein the actuator further comprises an encoder.

8. The knitting machine for clothing according to claim 2, wherein the connector is configured to be movable by a solenoid valve.

9. The knitting machine for clothing according to claim 8, wherein the connector is one of a plurality of connectors of the knitting machine and the solenoid valve is one of a plurality of solenoid valves of the knitting machine, and each of the plurality of solenoid valves is configured to move individually one of the plurality of connectors.

10. The knitting machine for clothing according to claim 1, wherein the screw thread of the connector is provided as a self-reversing screw.

11. The knitting machine for clothing according to claim 2, wherein the needle unit is one of a plurality of needle units of the knitting machine, the plurality of needle units are arranged side by side.

* * * * *